United States Patent [19]

Tamura et al.

[11] 4,047,387

[45] Sept. 13, 1977

[54] METHOD OF FORMING A SUBTERRANEAN WATER BARRIER AND A PLOW FOR USE THEREWITH

[75] Inventors: Yukio Tamura, Isehara; Katsu Hirosawa; Koji Ogaki, both of Hiratsuka, all of Japan

[73] Assignee: Kabushiki Kaisha Komatsu Seisakusho, Tokyo, Japan

[21] Appl. No.: 694,174

[22] Filed: June 9, 1976

[30] Foreign Application Priority Data

| | | |
|---|---|---|
| June 9, 1975 | Japan | 50-76822[U] |
| June 12, 1975 | Japan | 50-70187 |
| June 12, 1975 | Japan | 50-78694[U] |
| June 12, 1975 | Japan | 50-78695[U] |
| June 12, 1975 | Japan | 50-78696[U] |

[51] Int. Cl.[2] ..... E02B 13/00

[52] U.S. Cl. ..... 61/13; 61/63; 61/72.2

[58] Field of Search ..... 61/13, 11, 72.2, 72.6, 61/63, 12, 1, 105, 37

[56] References Cited

U.S. PATENT DOCUMENTS

| | | | |
|---|---|---|---|
| 3,585,804 | 6/1971 | Sramek | 61/72.6 |
| 3,917,174 | 11/1975 | Hildebrandt et al. | 61/12 X |

*Primary Examiner*—Jacob Shapiro

*Attorney, Agent, or Firm*—Armstrong, Nikaido & Marmelstein

[57] ABSTRACT

A method of forming a plurality of horizontal barriers in situ at a preselected depth beneath the soil surface and in a plane substantially parallel to the soil surface so as to be coextensive with a desired area, the barriers being made of a thermoplastic material such as asphalt for example, and forming further barriers joined to the horizontal barriers and extending vertically or obliquely toward the soil surface in order to surround the above-mentioned area, thereby improving soil having a poor water retention property. The method further comprises the steps of filling up chambers in a plow moving in the soil with the barrier forming material in the liquid form, leaking the material out of the chambers through passages of a given gap, and spreading the formed film laterally uniform by an ironing portion connected with the plow near the passages so as to render the formed water barrier uniform in thickness and free from apertures.

18 Claims, 15 Drawing Figures

METHOD OF FORMING A SUBTERRANEAN WATER BARRIER AND A PLOW FOR USE THEREWITH

BACKGROUND OF THE INVENTION

1. Field of the Invention

This invention relates to a method of forming subterranean water barrier and a plow for use in effecting the method.

2. Prior Art

As the population of the world today continues to grow, the problem of a food crisis becomes more pressing. One solution to this problem which has increasingly been focused is to improve the deserts occupying one third of land of the earth in order to make it suitable for agricultural, grazing and foresting purposes.

A technique of improving the desert soil has already been known in early 1900's. However, a technique of forming an economical sub-surface water barrier which provides an improved water retention property for the improvement of the soil, is relatively new and has been developed from about 1966. Prior art methods of forming a subterranean water barrier has been described in U.S. Pat. Nos. 668,362, 3,276,208, 3,405,528, 3,405,529, and 3,398,542, for instance. These prior art efforts generally comprise the steps of forming a translating cavity by moving a plow in the underground, spraying asphalt in the liquid form onto a bottom surface of the cavity which is formed by the font edge of the plow in order to spread the asphalt freely, and covering the spread asphalt with soil to thereby form an asphalt film. The conventional efforts have however suffered from various drawbacks mentioned below.

The major problem experienced with the asphalt film is the formation of apertures therein which, as will be described later, greatly reduce a water retention property enrichment of which is a principal aim that the subterranean water barrier is to accomplish. Even those apertures which have a relatively small diameter allow water leakage which is more or less the same in amount as in the case of those of a large diameter.

The asphalt in the liquid form sprayed on the soil surface and exposed to air tends to be separated just as water on an oiled surface is separated due to surface tension to form discontinuous water films, with the result that the asphalt is difficult to be spread uniformly even if the liquid asphalt layer is increased in thickness considerably. One major cause for aperture formation in the course of barrier preparation is the separation of asphalt due to its surface tension when the asphalt is exposed to air as it is sprayed onto the bottom surface of a cavity formed by the plow. Furthermore, the surface of asphalt is waved or disturbed by an asphalt flow injected from a nozzle and by covering soil, so that the asphalt layer makes a complicated movement, tending to permit of the mixing of air which is liable to cause apertures to be formed in the asphalt layer. Additionally, the asphalt cannot be covered uniformly with soil, so that the asphalt layer will have a combination of thinned portions, thickened portions and severed portions which are formed by soil that directly covers the bottom surface of the cavity.

Moreover, the asphalt tends to be mixed with soil falling at a rapid speed to thereby form a fragile asphalt film which can be easily broken by the deformation of soil thereabove that is caused as vehicles pass on the soil surface.

One proposal to prevent the aperture formation would be to supply a great amount of asphalt into the plow. However, a large supply of asphalt further causes the disturbance of the asphalt layer by the action of covering soil. The disturbance of the layer extends over a portion where soil falls toward a portion rearward of the plow where the disturbed asphalt layer is covered with soil or it covers soil, with the result that the formed layer has a multiplicity of wrinkles which consume an excessive supply of asphalt. Thus, this proposal only wastes asphalt being supplied. With the prior art asphalt film formation process, the above deficiencies cannot be overcome due primarily to the liquid asphalt being exposed to air and hence an hydrodynamically complicated movement of the liquid asphalt. An attempt has been made to solve the deficiencies by producing a gaseous ammonia atmosphere in the cavity and introducing asphalt emulsion into the cavity. However, due to the above-mentioned characteristic of asphalt, that is, easy separation because of its surface tension, it is fatally disadvantageous to leave the sprayed asphalt as it is until its surface is covered with soil.

Another proposal to prevent the aperture formation would be to make a distance between adjacent spray nozzles short, to make the nozzles to be positioned high above the bottom surface of the cavity in order to overlap the sprayed films and also to increase the spray angle which can be obtained by increasing the nozzle pressure, and by reducing the diameter of the orifice of the nozzle. However increasing the nozzle pressure damages the bottom surface of the cavity where the asphalt is mixed with a greater amount of sand, so that a fragile asphalt film is formed and the film tends to be increased in thickness, resulting in larger consumption of asphalt. Thus, the thickness of the asphalt layer right beneath the nozzle is prone to be greater than that of other portion of the layer, the asphalt film being unequal in thickness both transversely and longitudinally thereof. The reduced diameter of the nozzle orifice causes the orifice to be choked. The choked nozzle in the injection type then contributes to much more defects in the asphalt film. To eliminate this problem, it is necessary that the nozzle could be positioned high above the bottom surface of the cavity under a low pressure in order to overlap the sprayed film, and that a portion where the asphalt layer is covered with soil could be spaced apart from the nozzle a larger distance. This effort however makes the plow structure bulky and thus results in increased resistance to the advance of the plow in the underground, which increased resistance then causes a greater power loss on the tractor.

Moreover, the injection type method meets with only partial success because it is suitable merely for the formation of a horizontal film, and unsuitable for the formation of an inclined film in which case asphalt tends to flow down by gravity along the inclined surface of the cavity.

SUMMARY OF THE INVENTION

In accordance with the present invention the interior of a plow which is moved in soil is filled up with a barrier forming material without a cavity formed therein, the barrier forming material being spread by an ironing portion provided rearward of the plow to thereby form a subterranean water barrier. Since the barrier forming material fills the interior of the plow at all times, it is prevented from contact with air within the plow and hence from being separated due to its surface tension. An amount of the barrier forming material which is leaked out of the plow is substantially determined by a temperature of the material and a particle size of covering soil, and is affected slightly, but not largely, by the gap of restricted outlets provided at a rear end of the plow. The barrier forming material supplied excessively into the plow is held back by the pressure of the covering soil at a position rearward of the plow. A pressure control means is provided on the side of a barrier forming material supply in order to maintain the pressure within the plow at a constant rate, so that an amount of the material being supplied is controlled automatically. Thus, with the plow filled up with the barrier forming material, an excessive supply of the material to the plow can be avoided.

According to a method of the present invention, a barrier forming material can be kept under stable conditions in order to form a flawless uniform subterranean water barrier, because the barrier forming material is held completely out of contact with air in the plow; the material is fed at a constant rate; the material within the plow is spread sufficiently by an ironing portion provided rearward of the flow; and a pressure change between the interior and exterior of the plow is held relatively small.

Since the construction of the plow according to this invention is made small, the tractive resistance to the plow can be held to a minimum and the plow is prevented from vibrating largely, whereby it can be moved quietly beneath the soil surface.

A barrier forming material described in this specification is a thermoplastic material and more specifically asphalt is preferable. However, it may be a flowable material such for example as the admixture of milled compost and water, or an age-hardening material such as concrete.

Accordingly, a principal object of the invention is to provide an improved method of forming a subterranean water barrier.

Another object of the invention is to provide a method of forming a subterranean water barrier while a barrier forming material is pressed and spread by an ironing portion of a plow.

Still another object of the invention is to provide a subterranean water barrier which is pinhole-free and wrinkle-free.

Still another object of the invention is to provide a method of further improving a water retention property of soil by forming an inclined water barrier to be joined to a horizontal subterranean water barrier.

Yet another object of the invention is to provide a method of preventing the formation of a defective barrier film portion where adjacent water barriers are interconnected.

A still further object of the invention is the provision of an improved plow for forming a subterranean water barrier.

A yet further object of the invention is to provide a plow for forming a subterranean water barrier while a barrier forming material is pressed and spread by an ironing portion of the plow.

Still yet another object of the invention is to provide a plow capable of burying a barrier forming material under a low pressure.

A still yet further object of the invention is to provide a plow for preventing the formation of a defective barrier film portion where adjacent water barriers are interconnected.

Other objects, features and advantages of the present invention will be readily apparent from the following description taken in conjunction with the accompanying drawings in which like reference numerals or characters refer to like parts throughout.

BRIEF DESCRIPTION OF THE DRAWINGS

FIGS. 8A through 8E are cross-sectional views illustrative of a variety of modifications of subterranean water barriers formed by the method of the invention, in which FIGS. 8A through 8D show inclined barriers connected to the horizontal water barriers and FIG. 8E shows a vertical barrier connected thereto;

DETAILED DESCRIPTION OF THE PREFERRED EMBODIMENTS

Figure 1:
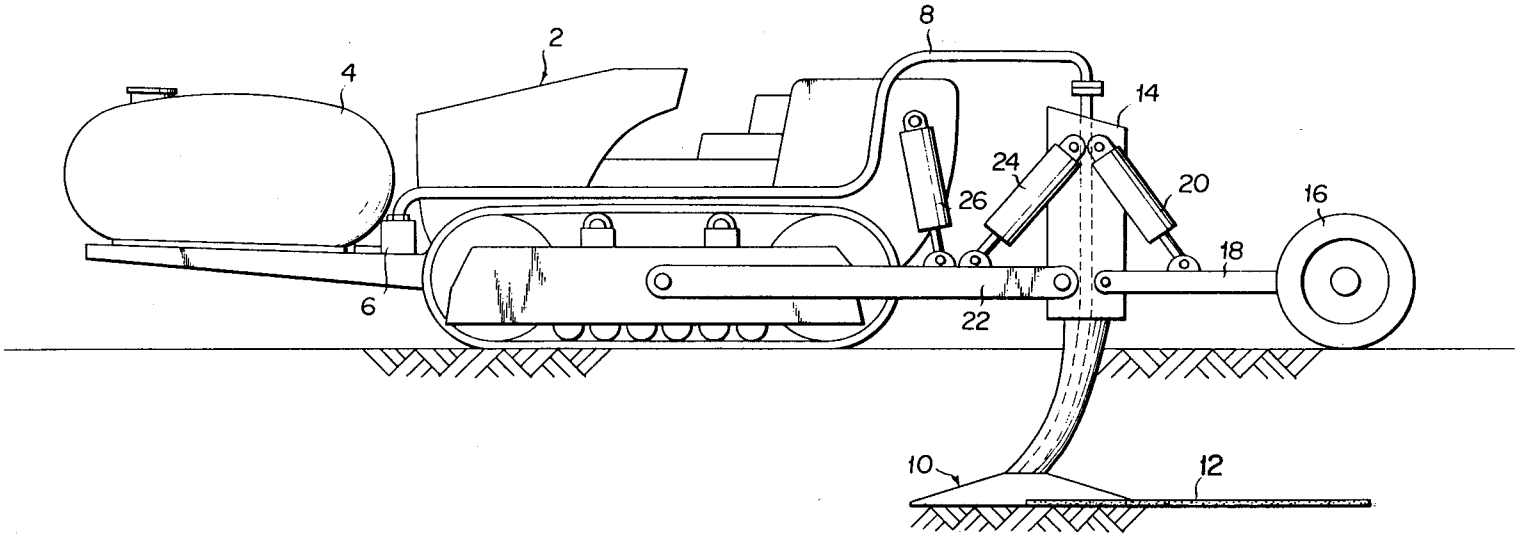
FIG. 1 is a schematic side elevational view of an apparatus useful in the method according to the present invention.

Referring now to FIG. 1, a tractor 2 has on its front portion an asphalt containing tank 4 from which asphalt is introduced by a discharge pump 6, through a conduit 8 toward a rear portion of the tractor, thence into a plow 10 connected to the conduit 8, the plow 10 then discharging the asphalt to form a subterranean water barrier 12 beneath the soil surface. A relief valve, not shown, is provided near the discharge pump 6 to control the pressure of asphalt being supplied. The plow 10 is connected to the conduit 8 by a plow support device 14. An auxiliary wheel 16 is rotatably coupled to the plow support 14 by an arm 18 and a cylinder 20, the wheel 16 serving to maintain the plow 10 at a desired depth under the soil surface. The support device 14 is mounted on the tractor 2 by an arm 22 and cylinders 24, 26.

Figure 2:
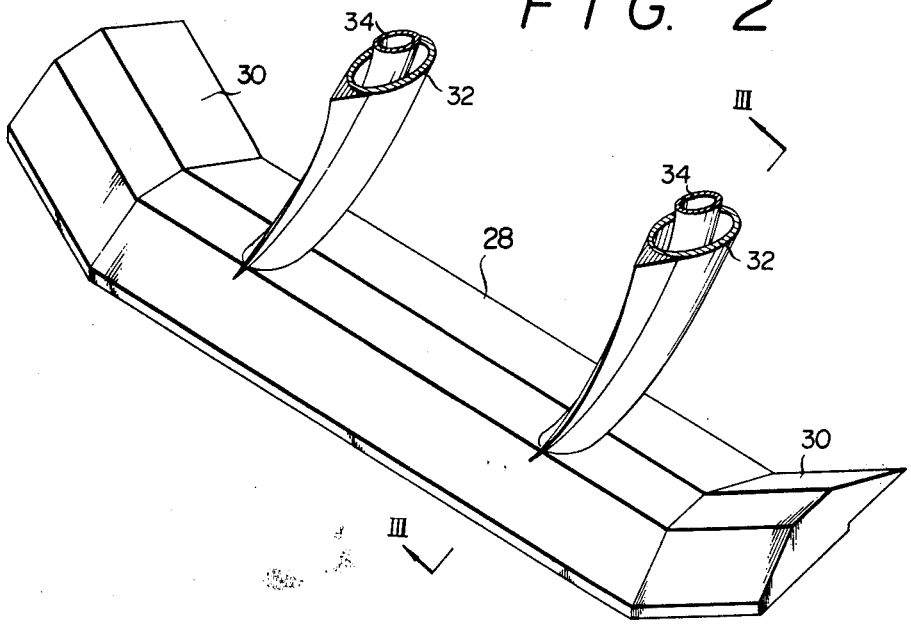
FIG. 2 is a perspective view of an embodiment of a horizontal plow.

FIG. 2 illustrates the plow 10 comprising a central portion 28 which, when in use, is held in parallel with the soil surface, and a pair of end portions 30 inclined relative to the central portion 28. A pair of plow connecting members 32 are each connected at one end with an upper surface of the plow and at the other end with the plow support 14. While in the illustrated embodiment the pair of connecting members 32 are mounted on the horizontal central portion 28 of the plow 10, they may be mounted on the inclined end portions 30. Furthermore, only one of the pair of connecting members 32 can be used and, in such an instance, it should be mounted centrally on the plow 10. Accommodated in each of the connecting members 32 is an asphalt supply pipe 34 having at one end a flange, not shown, coupled with the conduit 8 and having at the other end an opening for communication with the interior of the plow 10.

Figure 3:
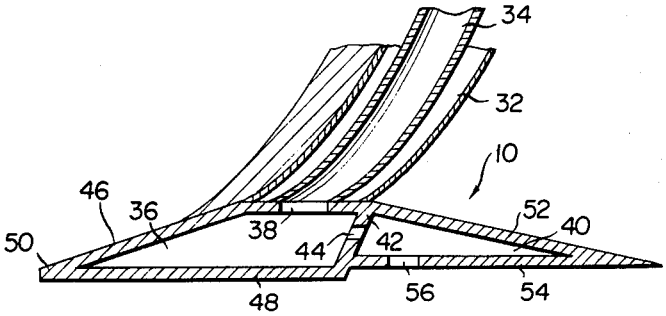
FIG. 3 is a cross-sectional view taken on line III—III of FIG. 2.

Referring to FIG. 3, there is shown an embodiment in which the plow 10 has an interior divided into first and second chambers. The first chamber 36 is connected with the asphalt supply pipe 34 through the opening, or an inlet 38. The first chamber 36 is thus capable of being filled with the asphalt being supplied. The first chamber 36 is separated from the second chamber 40 by a partition wall 42 which is provided with a plurality of holes 44 having a relatively small diameter and arranged transversely of the plow 10, through which holes 44 the asphalt is supplied from the first chamber 36 to the second chamber 40. The first chamber 36 is formed by a forwardly and downwardly sloped front upper wall 46 and a front lower wall 48, there being provided a distal end 50 shaped like a knife edge to reduce the resistance when the plow 10 advances in the soil. The second chamber 40 is formed by a rear upper wall 52 and a rear lower wall 54 which is provided with a plurality of asphalt discharge outlets 56 formed therein at spaced locations along the transverse direction of the plow 10. The asphalt outlets 56 may however be a single slit extending transversely of the plow 10. Importantly, the rear lower wall 54 is spaced upwardly from the front lower wall 48 by a distance of from 5mm to 10mm. With this construction, asphalt outlets 56 can be spread uniformly by the ironing action of the rear lower wall 54.

Figure 4:
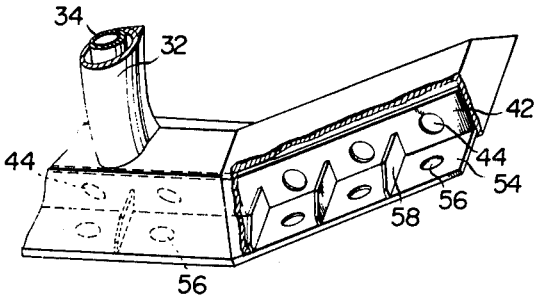
FIG. 4 is a fragmentary perspective with parts cut away of the plow shown in FIG. 2.

With reference to FIG. 4, the second chamber 40 at the inclined end portion 30 has therein a plurality of longitudinal partitions 58 each projecting in a direction perpendicular to the partition wall 42. The partitions 58 may of course be provided in the central portion 28 and the inclined end portion 30. The longitudinal partitions 58 function to bury asphalt uniformly and reinforce the plow 10 proper. The partitions 58 may however be omitted. It is preferable that the holes 44 formed in the partition wall 42 at the horizontal central portion 28 have an equal diameter and those at the inclined end portion 30 have diameter becoming progressively larger toward the free ends of the portions 30. It is likewise preferable that the asphalt outlets 56 formed in the rear lower wall 54 at the central portion 28 have an equal diameter and those at the inclined end portion 30 have diameters growing progressively larger toward the free ends of the portion 30. This construction is necessary to bury asphalt uniformly over the full width of the plow 10, because asphalt pressure within the inclined end portion 30, becomes lower as measured toward the free ends of the inclined portion 30. The total area of the holes 44 should not have smaller than that of the asphalt outlets 56.

Figure 5:
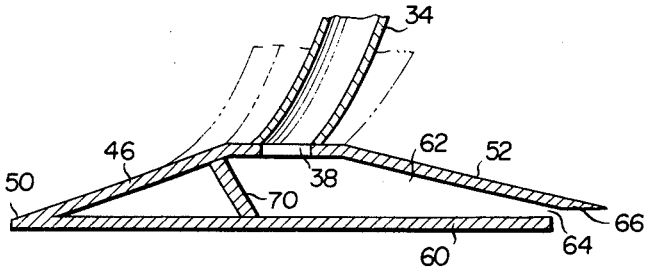
FIG. 5 is a view similar to FIG. 3 but showing another embodiment of the plow.

FIG. 5 shows another embodiment of the plow, in which the interior of the plow is not divided into two chambers, and asphalt from the supply pipe 34 can enter a chamber 62 and be discharged out of a slit outlet 64. The rear upper wall 52 has a rear free end 66 tapered and projecting slightly rearwardly from a rear free end of a rear lower end 60. A partition 70 prevents asphalt from going to a front portion of the plow 10 and further serves to stiffen the plow structure.

Figure 6:
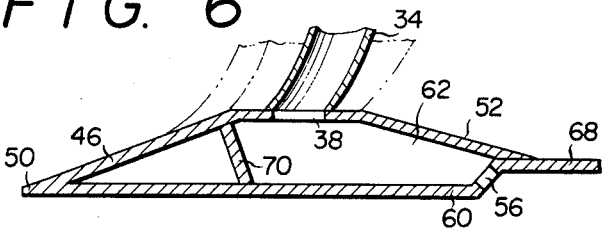
FIG. 6 is a view similar to FIG. 5 but showing still another embodiment of the plow.

FIG. 6 shows still another embodiment of the plow of the one-chamber type, in which an ironing plate 68 is provided on a rear end of the rear upper wall 52. There is thus formed a stepped portion between the rear lower wall 60 and the ironing plate 68 so that asphalt discharged from the asphalt outlet 56 will be spread and buried uniformly by the ironing plate 68. These embodiments shown in FIG. 5 and FIG. 6 are proved to be useful for the vertical plow.

A process of forming a subterranean barrier by the above-mentioned apparatus will now be described with particular reference to FIGS. 1 and 3.

With the plow 10 positioned at a preselected depth beneath the soil surface, at which depth a subterranean water barrier 12 is to be formed in situ, the tractor 2 draws the plow 10 horizontally, during which time heated asphalt in the liquid form contained in the tank 4 is fed continuously into the first chamber 36 of the plow 10 via the conduit 8. The results of an experimental test indicate that the temperature of the heated asphalt, affecting the quality of the formed barrier, is suitably in the range of about 135°–170° C (for the penetration index 80∼100) and preferably in the range of about 145°–150° C (for the penetration index 80∼100). Asphalt pressure within the first chamber 36 of the plow 10 should not exceed 1.0 kg/cm$^2$ and be preferably in the range of 0.3–0.5 kg/cm$^2$. The asphalt which has filled the first chamber 36 then flows into and fills the second chamber 40 through the holes 44 formed at spaced intervals in the partition wall 42.

The asphalt in the second chamber 40 then flows out through the outlets 56 in the rear lower wall 54. The pressure of asphalt when flowing out of the plow does not exceed about 0.1 kg/cm$^2$. Thus, as the plow 10 advances, asphalt supplied continuously from the asphalt tank 4 fills the first chamber 36 and the second chamber 40 at all times, and cannot be exposed to an atmosphere within or outside the plow 10. As the plow 10 progresses continuously in the soil at the preselected depth, the soil is divided into an upper soil portion supported on the plow 10 and a lower exposed soil portion. The asphalt out of the plow 10 flows onto the surface of the lower exposed soil portion, and at the same time, is spread uniformly over the entire width of the plow 10 by the ironing action of the rear lower wall 54. Since the rear lower wall 54 is heated by the supplied asphalt in the liquid form, the wall 54 simultaneously prevents the discharged asphalt from being separated due to its surface tension. The formed water barrier just passed the rear lower wall 54 is covered with supported upper soil flowing down continuously from above the plow 10, so that the subterranean water barrier 12 of a uniform thickness which is pinholefree and is not disturbed, can be formed at the preselected depth beneath the soil surface.

The water barrier 12 is usually composed of a pure asphalt layer and mixed layers of soil and asphalt on the opposite sides of the pure asphalt layer. The more a ratio at which the pure asphalt layer occupies a portion of the water barrier 12 becomes larger, the more the barrier becomes extensible. And the more extensible barrier is preferable. The above ratio varies with the temperature of asphalt in the liquid form. As the temperature of asphalt gets higher, its viscosity gets lower and asphalt tends to percolate between soil particles, with the result that the mixed layers in the water barrier become increased. Conversely, as the temperature of asphalt gets lower, its viscosity gets higher and asphalt which tends to percolate between soil particles becomes reduced, with the result that the pure asphalt layer in the water barrier becomes increased. According to the results of an experimental test, asphalt in the liquid form should suitably have a temperature of about 135° – 170°

C and preferably have a temperature of about 145° - 150° C (for the penetration index 80~100).

Figure 7:
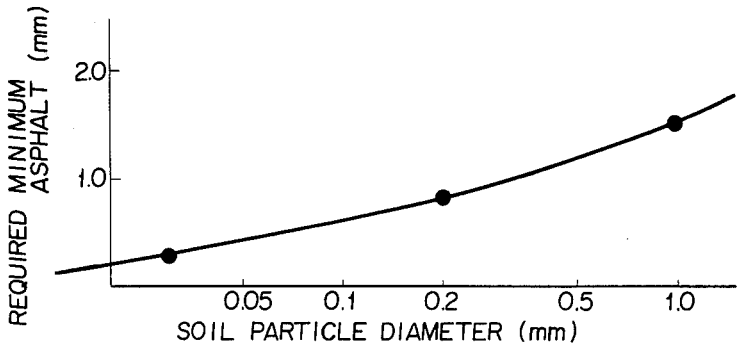
FIG. 7 is a graph showing the relation between the sizes of soil particles and the minimum amount of asphalt required to be sprayed.

The relation between the sizes of soil particles and the thickness of a water barrier film will now be described. A minimum amount of asphalt required to be spread for forming a flawless water barrier is substantially dominated by sizes of soil particles. FIG. 7 shows the relation between the sizes of soil particles and the minimum amount of asphalt required to be spread, the amount of asphalt being indicated by the thickness of a pure asphalt layer. With clayey soil having a particle size of not more than 0.1mm. asphalt was substantially prevented from percorating into the soil and the water barrier formed was substantially a pure asphalt layer having a thickness of not more than 0.5mm. With sand of an Iranian desert having an average particle size of 0.2mm, the thickness of the pure barrier was 0.7 - 0.9 mm, the thickness of the mixed barrier of asphalt and sand being 1.8 - 2.0 mm. With coarse sand of an average particle size of 1.0mm, asphalt to form the pure barrier having a thickness of 1.4 - 1.5mm must be spread.

According to the in situ formation of a barrier under a low pressure of this invention, asphalt pressure out of the asphalt outlets 56 is about 0.1 kg/cm$^2$, so that excessive asphalt can be prevented from flowing out of the plow and a required amount to be spread can be held at a minimum. Since asphalt in the liquid form is supplied continuously to the plow 10 from the asphalt container tank 4, a supplied amount is possible to be in excess of a spread amount. In this instance, however, the discharged asphalt is covered with the supported upper soil falling continuously thereon at a rearward position of the plow, the discharged asphalt being subjected to pressure due to weight of soil above the barrier thereby preventing excessive asphalt from being discharged out of the plow 10. Concurrent with this, the relief valve near the discharge pump 6 relieves the pressure of asphalt being supplied, so as to prevent an excessive supply of asphalt to the first chamber 36 and the second chamber 40. Thus, the plow 10 is at all times supplied with an amount of asphalt which is equal to that being discharged. The plow 10 is always filled up with asphalt accordingly.

A satisfactory subterranean water barrier could be prepared by the plow traveling at a speed of 2~4 km/h.

Figure 8A:
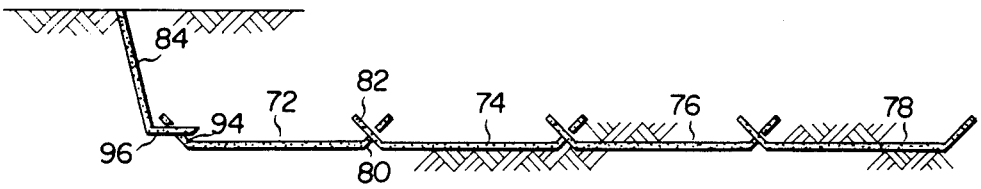

An adjoining subterranean water barrier to be joined to a first subterranean water barrier will be described. FIGS. 8A through 8E illustrate examples in which subterranean water barrier are formed in situ according to a process of the present invention. In FIG. 8A, a first subterranean water barrier 72 is formed at a preselected depth in the soil in accordance with the process of the invention. Then, the plow is moved laterally, and an adjoining subterranean water barrier 74 is formed at the same depth as the first barrier 72 and in the same manner as the first barrier 72. At this time, the plow 10 is so moved as to allow an inclined portion 80 of the first barrier 72 to be intersected by an inclined portion 82 of the adjoining barrier 74, so that the inclined portion 82 will cut the inclined portion 80. Thus, the first barrier 72 and the adjoining barrier 74 are joined together by the respective inclined portions. The above-mentioned process is repeated to form a third barrier 76, a fourth barrier 78 and so forth, thereby forming subterranean water barriers in situ at a preselected depth in the soil with the barriers covering a wide area.

Figure 9:
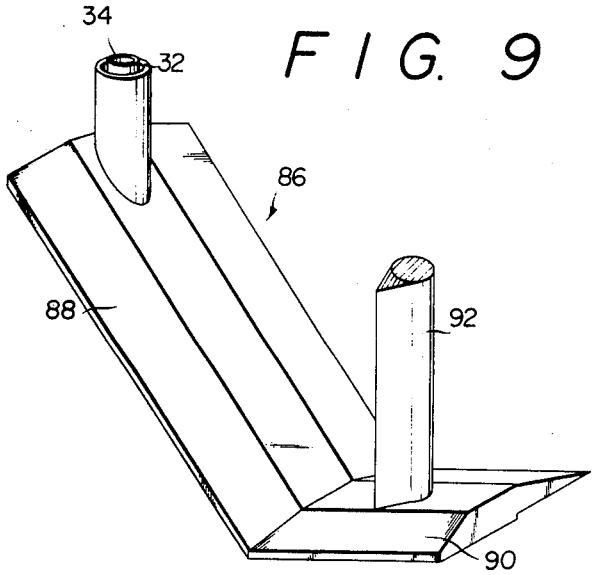
FIG. 9 is a perspective view of an embodiment of an inclined plow.

Further in accordance with the invention, an inclined barrier 84 can be formed which is joined with the first barrier 72 to provide an improved property of water retention. To form the inclined barrier 84, an inclined plow 86 shown in FIG. 9 is used. The inclined plow 86 comprises an inclined portion 88 and a horizontal portion 90, the inclined portion 88 having at its top end a plow connecting member 32 connected at one end thereto and the horizontal portion 90 having a plow connecting member 92 connected at one end thereto. Each of the other ends of the connecting members 32, 92 is affixed to the plow support 14. Accommodated in the connecting member 32 is the asphalt supply pipe 34 having at one end an unshown flange coupled with the conduit 8 and at the other end an opening communicating with the interior of the plow 86.

Figure 8B:
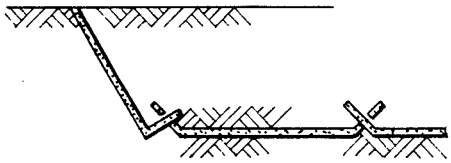
Figure 8C:
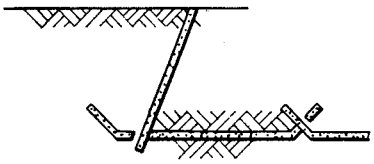
Figure 8D:
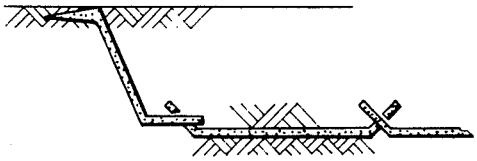
Figure 8E:
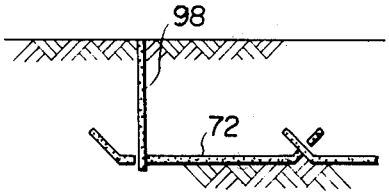
Figure 10:
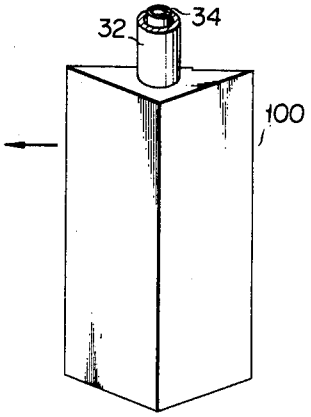
FIG. 10 is a side elevational view of an embodiment of a vertical plow.

A process of forming the inclined barrier 84 in the soil by the use of the inclined plow 86 will be described. As the inclined plow 86 advances, the horizontal portion 90 thereof cuts the inclined portion 94 of the first water barrier 72 with a horizontal portion 96 of the inclined barrier 84 joined to the inclined portion 94 of the first water barrier 72. With the inclined barrier 84 thus formed, moisture in the soil can be prevented from getting out laterally of the water barrier table, thus increasing a water retention property. FIGS. 8B through 8D illustrate other modifications of the inclined barrier. With reference to FIG. 8E, there is shown an embodiment wherein a vertical barrier 98 is joined to the water barrier 72. To form the vertical barrier 98, a vertical plow 100 of a structure such as shown in FIG. 10 is employed. And its cross-section is the same as a horizontal plow shown in FIG. 3 through FIG. 6. The vertical plow 100 is moved forward in the direction of the arrow.

Figure 11:
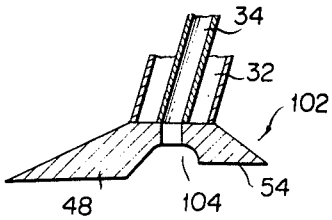
FIG. 11 is a vertical cross-sectional view of a simplified form of the plow employable in the invention.

FIG. 11 shows a simple plow 102 which can be used in the process according to the present invention. Similar to the plow 10 of FIG. 3, asphalt in the liquid form is introduced via the asphalt supply pipe 34 into a room 104 in the plow 102, and then discharged from the room whereupon it is spread uniformly by the ironing action of the rear lower wall 54 to form a subterranean water barrier. The rear lower wall 54 is elevated higher than the front lower wall 48 as in the case of the plow 10 shown in FIG. 3.

With the invention thus fully described, it is clear that the objects as above stated have been realized in a simple and throughly practicable manner. It is understood, however, that the invention itself is not to be limited by the exact details disclosed, as numerous modifications or changes will readily occur to one skilled in the art within the scope of the invention as expressed in the following claims.

What is claimed is:

1. A method of forming a continuous flexible subterranean water barrier of congealed thermoplastic material, said barrier composed of a plurality of separately formed barriers having finite dimensions, each separate barrier in transverse section having a central portion continuous with lateral side portions wherein each side portion is inclined relative to said central portion and terminate in a lateral edge at an elevation different from the elevation of said central portion, comprising:

I. forming a first barrier as defined above at a preselected depth beneath the soil surface by the steps of:

a. moving a plow having a cavity therein through the soil to continuously displace the soil upwardly at said depth thereby separating the soil into an upper portion supported by the plow and an exposed lower portion;

b. concurrently introducing said thermoplastic material into the cavity of said plow to fill it up without leaving any void portion;

c. ironing said thermoplastic material so as to spread same over uniformly in the transverse direction of said plow by passing said thermoplastic material through a restricted outlet from said plow so as to form a congealing coating of said material, said restricted outlet being defined between a rear bottom surface of said plow and the lower exposed soil portion and being located at the rear end portion of said plow; and d. continuously covering said coating by free flow of said supported soil simultaneously with releasing an excess pressure on said thermoplastic material within said plow which exceeds a balanced pressure created by a soil pressure at the point of tail end of said plow and a pressure of said thermoplastic material inside said plow thereby preventing an excess outflow of said material from said plow, whereby said first barrier of uniform thickness is formed; and II. forming an adjoining barrier in a path parallel to the first path and at the preselected depth to engage said first barrier by repeating the steps employed in forming the first barrier and including continuously intersecting the adjacent lateral side portion of said first barrier with a new lateral side portion of said adjoining barrier, thus joining said first barrier and said adjoining barrier to provide a continuous water barrier laterally and longitudinally by separately formed barriers.

2. The method of claim 1 further comprising forming an inclined water barrier in contact with one of edges of said continuous lateral water barriers by repeating the steps employed in forming the first barrier to form a reservoir for water in the soil thereby preventing any possible leakage of water from the reservoir.

3. The method of claim 2 wherein said inclined water barrier is upright with respect to said continuous lateral barriers.

4. The method of claim 1 wherein said thermoplastic material is asphalt and being spread at a temperature from about 135° to 170° C (for the penetration index 80~100).

5. The method of claim 4 wherein the temperature of said asphalt is about 145° to 150° C (for the penetration index 80~100).

6. The method of claim 1 wherein the gap of said restricted outlet is about 5 to 12mm.

7. The method of claim 1 wherein the thickness of said barrier is about 1.5 to 2.0mm, which includes a pure asphalt layer and a mixed layer of asphalt and sand.

8. The method of claim 1 wherein said thermoplastic material is introduced into the plow under the pressure of about 0.3 to 0.5 kg/cm$^2$ and wherein said thermoplastic material is introduced into the soil under the pressure of about 0.1 kg/cm$^2$.

9. A subterranean plow for forming a subterranean water barrier said plow comprising:

a. vertical support means including means for moving said plow through soil to form a space in the soil;

b. a plow body comprising a room means for receiving a thermoplastic material under pressure;

an outlet means in said body for allowing said thermoplastic material to flow from said room means into the space formed in the soil;

ironing means positioned to the rear of said outlet means for uniformly spreading said thermoplastic material over the width of said plow body in the space formed in the soil; and c. conduit means positioned within said vertical support means for carrying said thermoplastic material into said room means.

10. The subterranean plow of claim 9 wherein said room means comprises:

a. a first room for receiving said thermoplastic material, said first room being located at the front portion of said room means;

b. a second room communicating with said first first room, said second room being located at the rear portion of said room means wherein said outlet means is located in the bottom wall of said second room and wherein said ironing means is the bottom wall of said second room; and c. a partition wall positioned between said first and second rooms, said partition wall having a plurality of holes therein wherein said first and second rooms communicate through said holes.

11. The subterranean plow of claim 9 wherein said room means is located in the rear portion of said plow body and wherein said ironing portion is located to the rear of said room means and is positioned above the bottom of said room means.

12. The subterranean plow of claim 10 wherein said plow body comprises a central portion and a pair of lateral side portions, each side portion being inclined relative to said central portion and terminating in a lateral edge at an elevation different from the elevation of said central portion.

13. The subterranean plow of claim 12 wherein the outlet means of said thermoplastic material comprises a plurality of holes, the diameters of said outlet holes and said holes provided in said partition wall are gradually increasing from bottom to top at the pair of lateral side portions.

14. The subterranean plow of claim 10 further including leveling means for leveling the soil raised by said subterranean plow body, said leveling means being connected to said power means and positioned on the ground immediately after said plow body.

15. The subterranean plow of claim 11 wherein said plow body comprises a central portion and a pair of lateral side portions, each side portion being inclined relative to said central portion and terminating in a lateral edge at an elevation different from the elevation of said central portion.

16. The subterranean plow of claim 15 wherein the opening of said outlet means is gradually increasing from bottom to top at the pair of lateral side portions.

17. The subterranean plow of claim 16 wherein said outlet means is a slit.

18. The subterranean plow of claim 17 wherein said outlet means comprises plural holes.

* * * * *